US009215918B2

(12) United States Patent
Kao et al.

(10) Patent No.: US 9,215,918 B2
(45) Date of Patent: Dec. 22, 2015

(54) LUGGAGE BAG WITH REMOVABLE ORGANIZER

(71) Applicant: ORIGAMI, LLC, Portland, OR (US)

(72) Inventors: David Kao, Portland, OR (US); Richard P. Christen, Bend, OR (US)

(73) Assignee: OREGAMI, LLC, Fairview, OR (US)

( * ) Notice: Subject to any disclaimer, the term of this patent is extended or adjusted under 35 U.S.C. 154(b) by 0 days.

(21) Appl. No.: 14/293,588

(22) Filed: Jun. 2, 2014

(65) Prior Publication Data

US 2014/0360831 A1 Dec. 11, 2014

Related U.S. Application Data

(60) Provisional application No. 61/833,270, filed on Jun. 10, 2013.

(51) Int. Cl.

| | |
|---|---|
| ***A45C 13/03*** | (2006.01) |
| ***A45C 3/00*** | (2006.01) |
| ***A45C 5/14*** | (2006.01) |
| ***A45C 7/00*** | (2006.01) |

(52) U.S. Cl.

CPC ..... *A45C 13/03* (2013.01); *A45C 3/004* (2013.01); *A45C 5/14* (2013.01); *A45C 7/0045* (2013.01); *A45C 2003/002* (2013.01)

(58) Field of Classification Search

CPC .... A45C 7/005; A45C 7/0045; A45C 7/0059; A45C 7/0068; A45C 7/0072; A45C 11/26; A45C 13/03; A45C 5/06; A45C 11/02; A45C 13/02; B65D 21/0201; B65D 21/0213

USPC ..... 190/108, 1; 383/37, 38; 206/504; 220/23.4, 23.6

See application file for complete search history.

(56) References Cited

U.S. PATENT DOCUMENTS

| | | | | |
|---|---|---|---|---|
| 1,300,921 | A * | 4/1919 | Briggs | 190/110 |
| 3,315,772 | A * | 4/1967 | Katz | 206/287.1 |
| 3,530,961 | A | 9/1970 | Weissenbach | |
| 4,523,678 | A * | 6/1985 | Fox | 206/287.1 |
| 4,580,667 | A * | 4/1986 | Herwood | 190/110 |
| 4,718,524 | A | 1/1988 | Crumley | |
| 4,819,796 | A * | 4/1989 | Gerch et al. | 206/291 |

(Continued)

FOREIGN PATENT DOCUMENTS

| | | | |
|---|---|---|---|
| CA | 2091612 | * | 9/1994 |
| FR | 968013 A | * | 11/1950 |

*Primary Examiner* — Sue A Weaver

(74) *Attorney, Agent, or Firm* — David A. Crowther

(57) ABSTRACT

Embodiments of the invention provide a luggage bag, which includes an outer container and an organizer that is contained therein. The outer container includes a detachable garment flap having an envelope for storing one or more garments therein. The organizer includes a plurality of foldable compartments. The organizer can be stored within the outer container and covered by the detachable garment flap. The compartments can stack and fold onto each other and can fold into and out of the outer container. The compartments can be removably attached to each other by a connector, such as pile tape, snaps, buttons, etc. The compartments can be modular such that the organizer can be configured to include any desired number of compartments. In some embodiments, the organizer can occupy substantially the entire interior volume of the outer container. The compartments of the organizer are configured to unfold, deploy, and extend from the outer container.

18 Claims, 11 Drawing Sheets

(56) References Cited

U.S. PATENT DOCUMENTS

| | | | | | |
|---|---|---|---|---|---|
| 4,887,751 | A | | 12/1989 | Lehman | |
| 4,898,274 | A | * | 2/1990 | Stout et al. | 206/289 |
| 4,967,986 | A | * | 11/1990 | Schildkraut | 224/250 |
| 5,096,030 | A | | 3/1992 | Espinosa et al. | |
| 5,291,990 | A | * | 3/1994 | Sejzer | 206/748 |
| 5,501,324 | A | * | 3/1996 | Franklin et al. | 206/279 |
| 5,624,026 | A | | 4/1997 | Chernoff | |
| 6,168,022 | B1 | | 1/2001 | Ward et al. | |
| 6,334,519 | B1 | * | 1/2002 | Tong | 190/107 |
| 6,523,653 | B2 | | 2/2003 | Roegner | |
| 2002/0023812 | A1 | * | 2/2002 | Bernbaum et al. | 190/111 |
| 2002/0074199 | A1 | * | 6/2002 | Albritton | 190/107 |
| 2004/0173427 | A1 | | 9/2004 | Chernoff | |
| 2005/0224305 | A1 | * | 10/2005 | Davis | 190/113 |
| 2007/0044877 | A1 | | 3/2007 | Davidoff et al. | |

* cited by examiner

LUGGAGE BAG WITH REMOVABLE ORGANIZER

RELATED APPLICATION DATA

This application claims the benefit of commonly assigned U.S. Provisional Pat. Application Ser. No. 61/833,270, filed Jun. 10, 2013, which is hereby incorporated by reference in its entirety.

FIELD OF THE INVENTION

This application pertains to luggage, and more particularly, to a luggage bag having a removable organizer containable therein.

BACKGROUND

Millions of travelers go from one place to another every day around the world. The travelers usually must carry their personal belongings in some kind of bag or container, especially if the trip lasts for more than one day. Various types of luggage, baggage, and related containers have been proposed for transporting items safely and securely from one destination to another. However, conventional luggage and bags are often bulky and awkward, and fail to provide the ability to efficiently fit, organize, and access a person's belongings. Another downside of conventional luggage is the failure to accommodate various types of belongings in a single container. For example, if a person wishes to travel with garments such as suits and dress shirts without ruining or wrinkling the garments, they must carry two separate bags—one to accommodate the suits and dress shirts, and another to accommodate their remaining belongings. As travel companies such as airlines continue to increase fees on baggage and limit options on what can be carried on to a plane, for example, significant frustration for travelers can mount. Moreover, if one is forced to use multiple separate bags, there is a greater likelihood of losing a traveler's personal items to carelessness or theft.

Accordingly, a need remains for an improved luggage bag having an internal removable organizer, and which also accommodates multiple types of personal belongings including garments and other belongings. Embodiments of the invention address these and other limitations in the prior art.

The foregoing and other features of the invention will become more readily apparent from the following detailed description, which proceeds with reference to the accompanying drawings.

DETAILED DESCRIPTION OF THE EMBODIMENTS

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details. In other instances, well-known methods, procedures, and components, have not been described in detail so as not to unnecessarily obscure aspects of the embodiments.

It will be understood that, although the terms first, second, etc. may be used herein to describe various elements, these elements should not be limited by these terms. These terms are only used to distinguish one element from another. For example, a first handle could be termed a second handle, and, similarly, a second handle could be termed a first handle, without departing from the scope of the inventive concept.

It will be understood that when an element or layer is referred to as being "on," "coupled to" or "connected to" another element or layer, it can be directly on, directly coupled to or directly connected to the other element or layer, or intervening elements or layers may be present. In contrast, when an element is referred to as being "directly on," "directly coupled to" or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1:
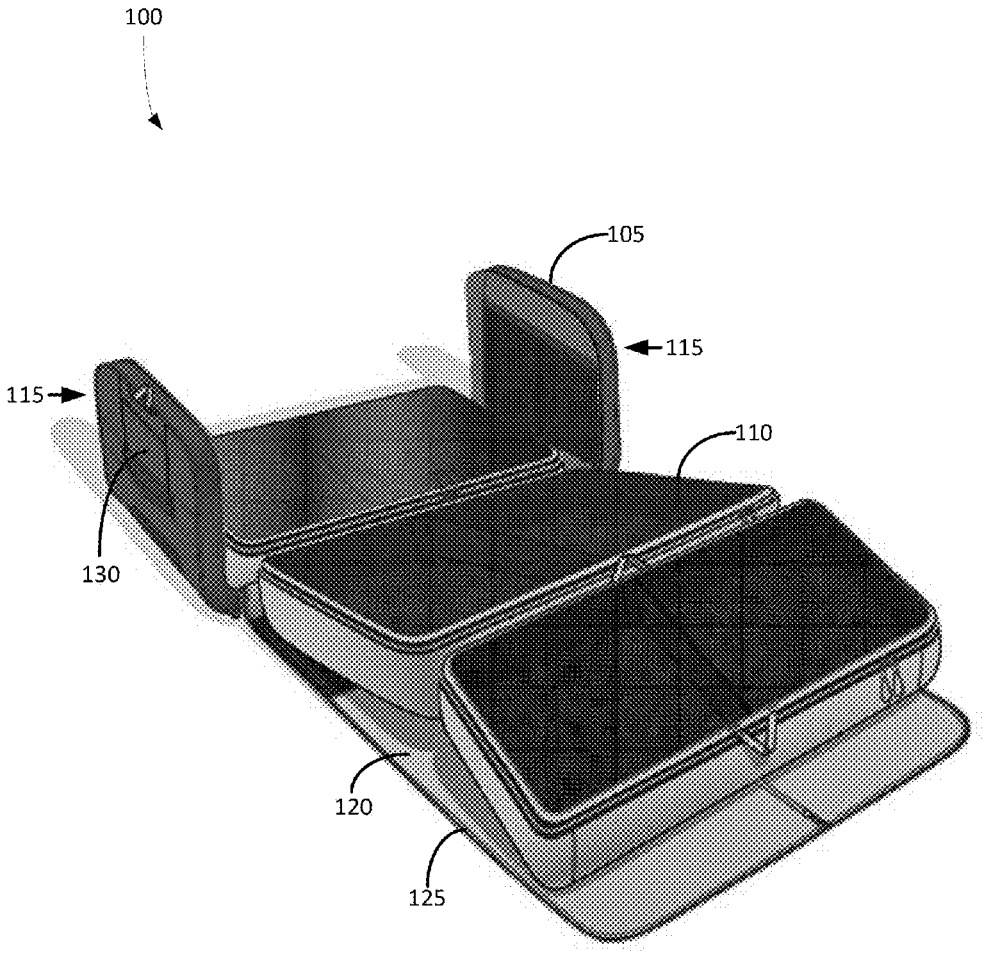
FIG. 1 illustrates a luggage bag including an outer container in an opened configuration and a removable organizer in accordance with various inventive concepts of the present invention.
Figure 2:
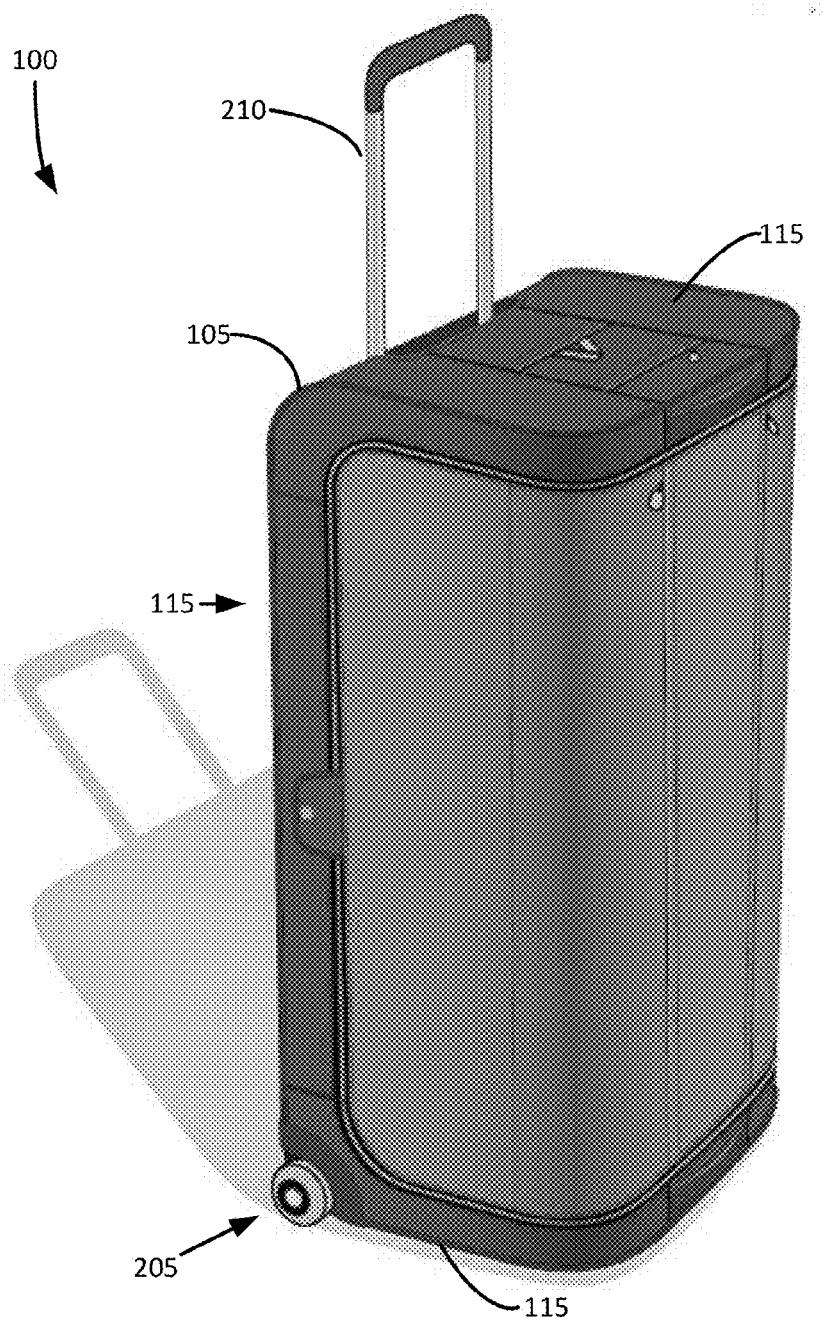
FIG. 2 illustrates the luggage bag of FIG. 1 in a closed configuration.

FIG. 1 illustrates a luggage bag 100 including an outer container 105 in an opened configuration and a removable organizer 110 in accordance with various inventive concepts of the present invention. FIG. 2 illustrates the luggage bag 100 of FIG. 1 in a closed configuration. Reference is now made to FIGS. 1 and 2.

The luggage bag 100 generally includes an outer container 105 and a removable organizer 110, which can be contained within the outer container 105. As will be discussed, the organizer 110 allows items to be stored securely and conveniently within the container 105. Also, the organizer 110 fits neatly into the container 105. Moreover, the organizer 110 can be modular and configurable for additional benefits, which are discussed in detail below.

The outer container 105 can be of any suitable type. For example, the container 105 can have rigid walls (e.g., 115) so that it essentially maintains its shape whether in the opened configuration as shown in FIG. 1 or the closed configuration as shown in FIG. 2. Alternatively, the container 105 can have flexible or collapsible walls (e.g., 115). The container 105 can also include a closure flap 120, which can include connective means such as a zipper 125 that allows the closure flap 120 to be selectively connected or disconnected from the walls 115, thereby placing the luggage bag 100 into either the closed configuration or the open configuration, respectively. The luggage bag 100 can include an external-access storage area 130, which can store a smart phone, airline ticket information, and the like.

The outer container 105 can also include other features that enhance portability. For example, the container 105 can include one or more wheels 205, which can be attached at the joining region of two or more walls 115, as shown in FIG. 2. The container 105 can also include a telescoping handle 210 (FIG. 2). It will be appreciated, that the container 105 can vary in many ways from the container 105 shown in the Figures. Indeed, the container 105 can be of any suitable type, can have any suitable shape, and can incorporate one or more additional features typically found on other bags, luggage, briefcases, handbags, purses, and the like.

Figure 3:
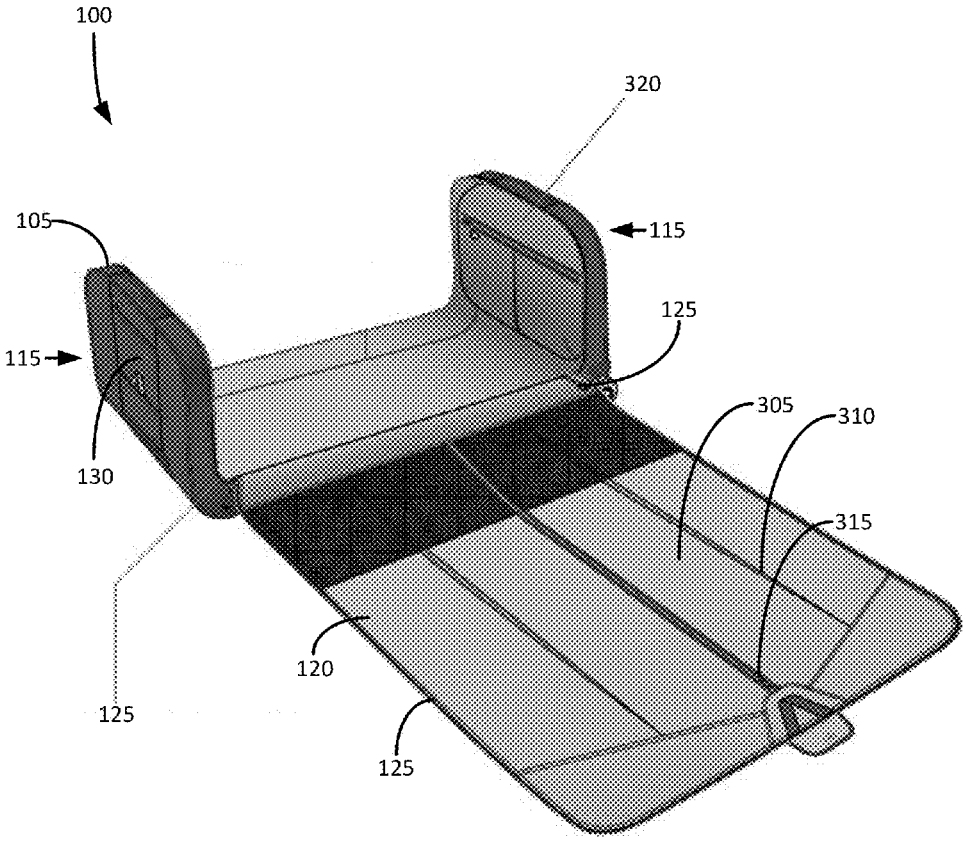
FIG. 3 illustrates the luggage bag of FIG. 1 in the opened configuration without the removable organizer, thereby revealing a detachable garment flap in accordance with various inventive concepts of the present invention.
Figure 4:
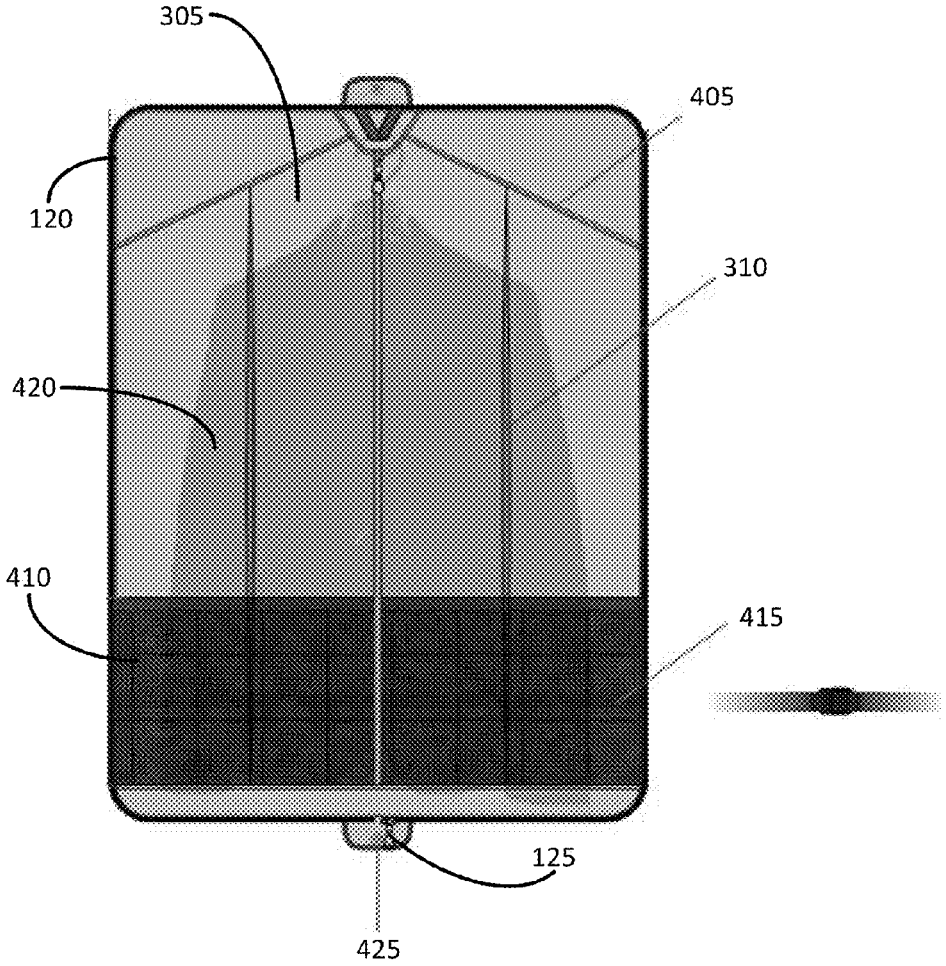
FIG. 4 illustrates the detachable garment flap of FIG. 3.

FIG. 3 illustrates the luggage bag 100 of FIG. 1 in the opened configuration without the removable organizer, thereby revealing a detachable garment flap 120 in accordance with various inventive concepts of the present invention. FIG. 4 illustrates the detachable garment flap 120 of FIG. 3. Reference is now made to FIGS. 1-4.

The closure flap 120 can be a detachable garment flap 120. The detachable garment flap 120 can include an envelope 305 in which garments such as suits, pants, shirts and the like can be neatly stored and transported. The detachable garment flap 120 is interchangeable with one or more different garment flaps to accommodate style preference, color, size, or the like. The envelope 305 can include one more pleated gussets 310 so that the volume of the envelope can automatically expand to accommodate multiple garments. The detachable garment flap 120 can be attached or detached to and from the luggage bag 100 using connection means such as the zipper 125. Other suitable connection means can include Velcro®, buttons, snaps, or the like. The garment flap 120 can also include its own zipper 315 or other suitable opening and closing means such as Velcro®, buttons, snaps, or the like, to enable efficient and convenient access to the envelope 305.

Referring to FIG. 4, the detachable garment flap 120 can include one or more shoulder seams 405. The volume of the envelope 305 can stop or otherwise be defined at least in part by the one or more shoulder seams 405. The garment flap 120 can also include webbing 410 for added ventilation. In addition, the garment flap 120 can include a strap and buckle mechanism 415 or other similar means for gathering and/or securing a lower portion of the various garments 420 stored within the envelope 305. The detachable garment flap 120 can include one or more sub-flaps 425 for covering and/or securing the zipper 125, as further described below.

One or more cargo pockets 320 may be disposed within the container 105, for example, on inside regions of the walls 115. The one or more cargo pockets 320 can each include its own zipper 315 or other suitable opening and closing means such as Velcro®, buttons, snaps, or the like.

Figure 5A:
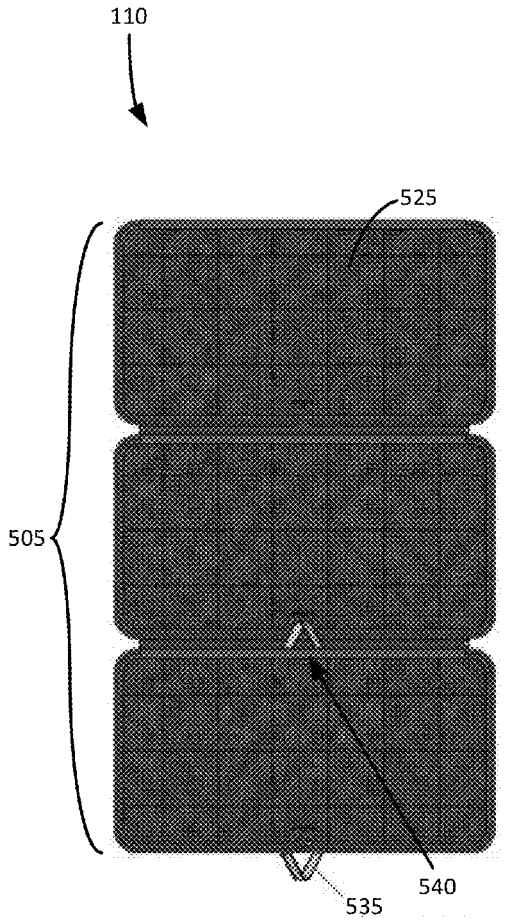
FIGS. 5A and 5B illustrate different views of the organizer of FIG. 1 including various compartments removed from the container of FIG. 1.
Figure 5B:
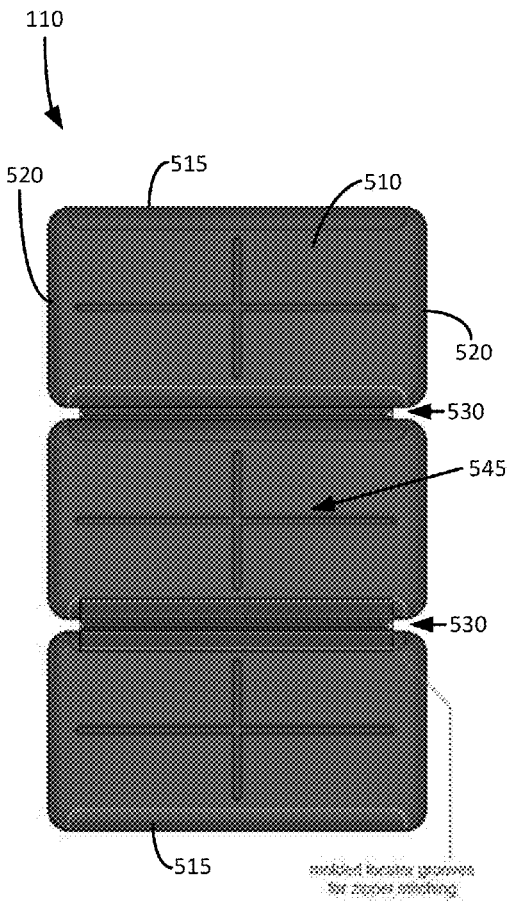
Figure 6:
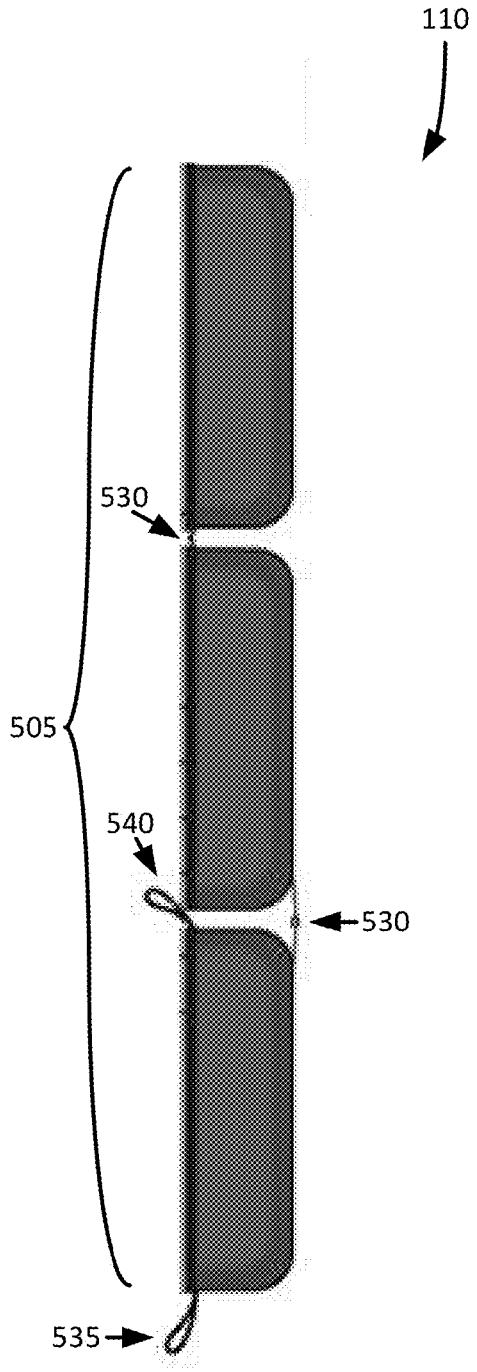
FIG. 6 illustrates another view of the organizer of FIG. 1.
Figure 7A:
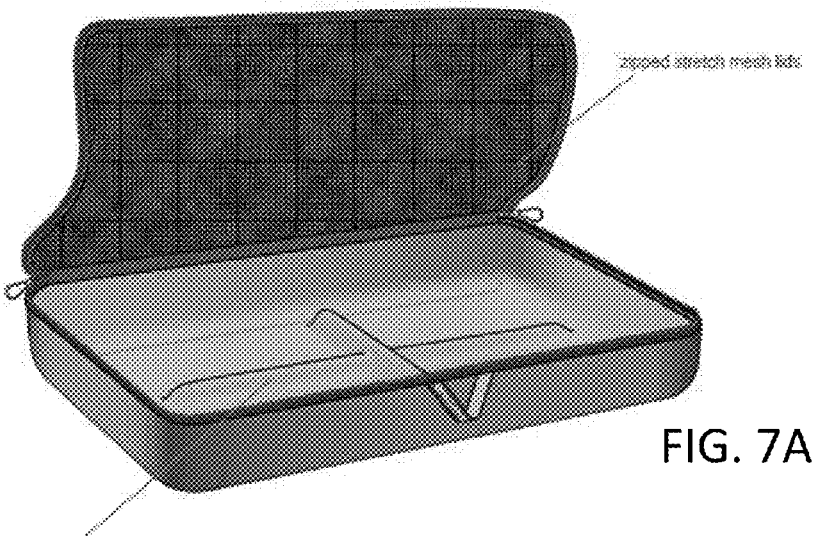
FIGS. 7A, 7B, and 7C illustrate various perspective views of a single compartment of the organizer of FIG. 1.
Figure 7B:
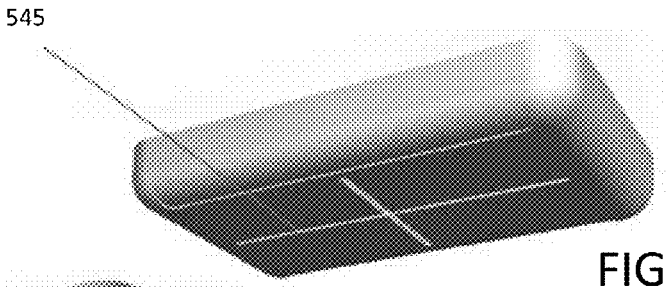
Figure 7C:
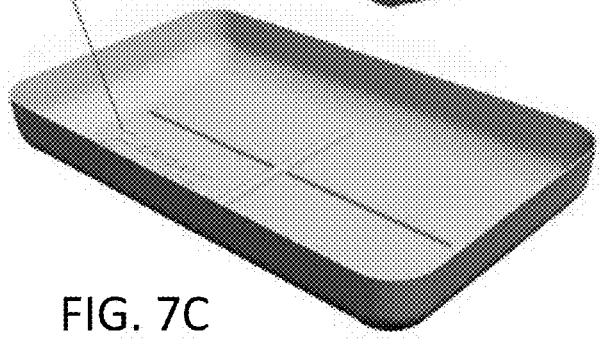
Figure 8:
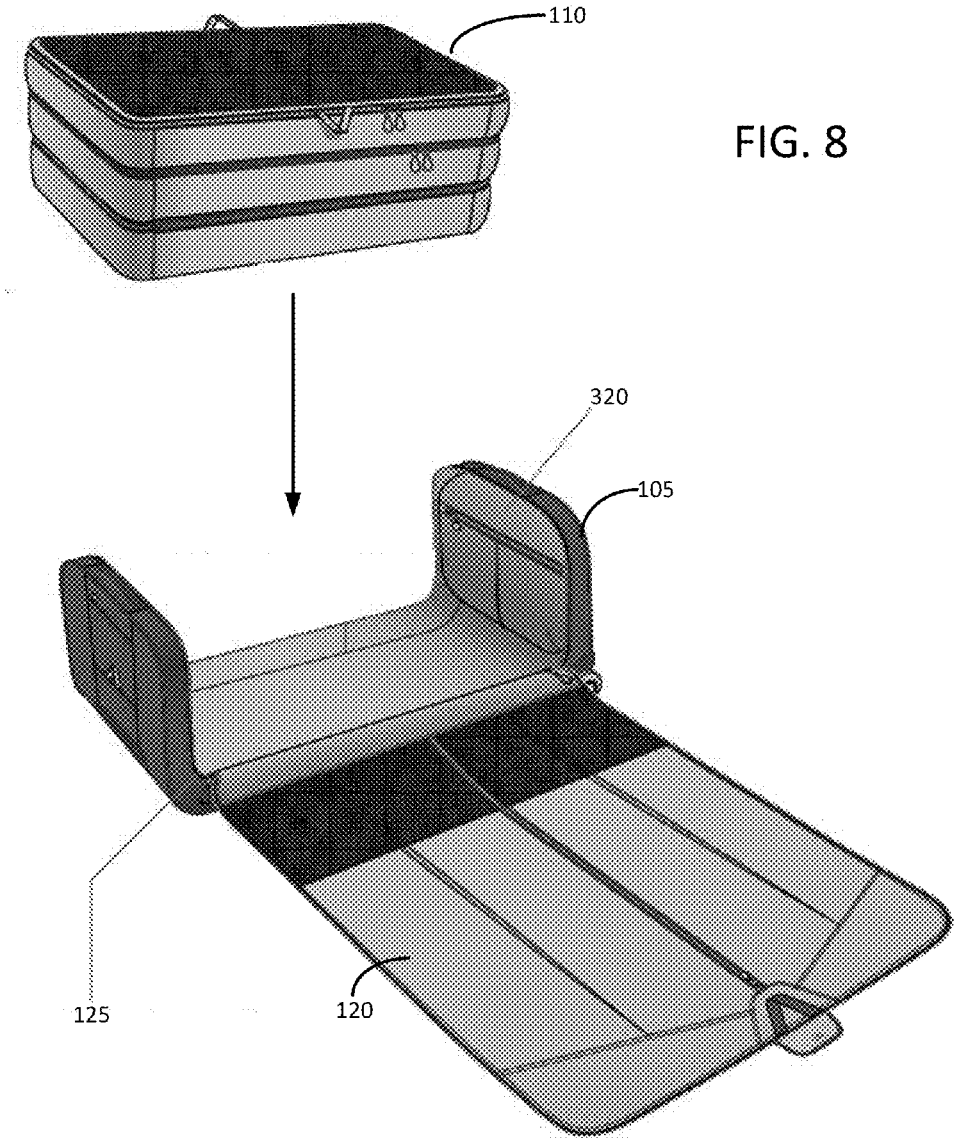
FIG. 8 illustrates the luggage bag of FIG. 1 including an outer container in an opened configuration and a removable organizer in a folded configuration in accordance with various inventive concepts of the present invention.

FIGS. 5A and 5B illustrate different views of the organizer 110 of FIG. 1 including various compartments 505 removed from the container of FIG. 1. FIG. 6 illustrates another view of the organizer 110 of FIG. 1. FIGS. 7A, 7B, and 7C illustrate various perspective views of a single compartment 505 of the organizer 110 of FIG. 1. FIG. 8 illustrates the luggage bag 100 of FIG. 1 including an outer container 105 in an opened configuration and a removable organizer 110 in a folded configuration in accordance with various inventive concepts of the present invention. Reference is now made to FIGS. 5A, 5B, 6, 7A, 7B, 7C, and 8.

The organizer 110 can include a plurality of hollow compartments 505. Each compartment 505 can include a plurality of walls 510, 515, 520, and 525 made out of compression molded material, which can include plastic, metal, rubber, composite material, or the like. Alternatively, the walls of each of the compartments 505 can be made of fabric or other suitable material. Each compartment 505 can be generally cuboid shaped. As such, each compartment 505 can include a bottom wall 510. Each compartment 505 can also include two long sidewalls 515 and two short sidewalls 520. The sidewalls 515 and 520 can trace the periphery of the bottom wall 510 and can extend substantially perpendicularly therefrom. The long sidewalls 515 can be opposite each other, and the short sidewalls 520 can be opposite each other.

Each compartment 505 can further include a top wall 525, which can be connected to the sidewalls 515 and 525, and that is opposite the bottom wall 510. The bottom wall 510 and sidewalls 515 and 520 can be substantially opaque while the top wall 525 can be at least partially light-transmissive. For instance, the top wall 525 can be made of a see-through mesh material and/or stretch-mesh material. The top wall 525 can also be at least partially removably attached to one or more of the sidewalls 515 and 520, for instance, via a zipper, snaps, or other closure. Accordingly, the top wall 525 can be detached (e.g., unzipped) from one or more of the sidewalls 515 and 520 to provide access into the compartment 505, and items can be placed within the compartment 505. Then, the top wall 525 can be selectively attached (e.g., zipped) to the sidewalls 515 and 520 to secure the items within the compartment 505.

The organizer 110 can include any suitable number of individual compartments 505. In the embodiments shown, there are three compartments 505, and the compartments fold and stack on each other. Thus, as shown in FIG. 8, the organizer 110 can be folded and stacked to be stored within the outer container 105, and the garment flap 120 can be closed over and can encapsulate the organizer 110. Then, when desired, the compartments 505 can be entirely removed from the container 105 and unfolded to deploy and extend from the container 105 as shown in FIG. 1. Moreover, the organizer 110 can be completely removed from the container 105 as shown in FIG. 8.

As shown in FIGS. 5A, 5B, and 6, the compartments 505 can be connected to each other via a connector 530. The connector 530 can be stitching or other type that permanently fixes the compartments 505 together. In other embodiments, the connector 530 can be a zipper, pile tape (e.g., VELCRO™), snaps, buttons, or other suitable connector for removably connecting the compartments 505. The compartments 505 can be aligned (when unfolded) such that adjacent long sidewalls 515 are connected together. Also, the connector 530 can be located along one edge or region of the bottom wall 510 or along one edge or region of the top wall 525. For instance, a bottom connector 530 can connect adjacent bottom walls 510, and a top connector 530 can connect adjacent top walls 525.

The middle compartment 505 of the organizer 110 includes the bottom connector 530 on one side and the top connector 530 on the opposite side. The top and bottom connectors 530 can, thus, alternate along the entire length of the organizer 110 such that the compartments 505 can stack up in sequence in a compact manner. The organizer 110 can be modular such that the compartments 505 can be configured in any desirable manner. For example, one or more compartments 505 can be attached and added to the organizer 110, or one or more compartments 505 can be detached and removed from the organizer 110.

Also, in some embodiments, the compartments 505 can include available connectors 530 extending along the short sidewalls 520 as well as along the long sidewalls 515 such that the compartments 505 can unfold to be aligned or transverse to each other. This modularity allows the organizer 110 to be configured as desired. The various compartments are foldable one atop the other. The organizer 110 can, thus, take up substantially the entire interior volume of the outer container 105 or less than the entire interior volume.

The organizer 110 can also include a first pull handle 535 or strap and a second pull handle 540 or strap. The pull handles can be, for example, a molded rubber pull or handle. Alternatively, the pull handles can be made of material, metal, plastic, or the like. The pull handles 535 and 540 can be located on the organizer 110 to facilitate moving the organizer 110 into and out of the outer container 505. For instance, the first pull handle 535 can be fixed to the outermost compartment 505, located at the end of the organizer 110, and the first pull handle 535 can be pulled to unfold, and deploy the organizer 110 from the container 105. Also, the compartment 505 at the end of the organizer 110 opposite the first pull handle 535 can be removably coupled to the container 105 (e.g., by pile tape, snaps, etc.) to facilitate deployment of the organizer 110 from the container 105.

Furthermore, as shown in FIGS. 5A, 5B, and 6, the second pull handle 540 can be included between the middle compartment 505 and the outermost compartment 505, and the second pull handle 540 can be lifted such that gravity causes folding of the compartments 505 on each other. The second pull handle 540 can then be used to further fold the compartments 505 on each other and move the organizer 110 into the container 105.

Also, when the organizer 110 is deployed from the container 105, the compartments 505 can face the same direction such that the top walls 525 are each aligned in a substantially continuous row. As such, the contents of each of the compartments 505 can be visible, and the compartments 505 can be highly accessible when deployed from the container 105.

It will be appreciated that the organizer 110 can be used within any suitable container and/or can be used and sold independently from the outer container 105. Also, individual compartments 505 can be sold separately and added to the organizer 110 as needed. Moreover, the compartments 505 within the organizer 510 can include interior dividing walls 545 for further separating or securing items within the respective compartment 505. The dividing walls 545 can be molded into the individual compartments 505 and/or have a height that is less than the height of the walls of each compartment 505. A debossed logo 705 can be imprinted directly into one or more of the walls 510.

Figure 9A:
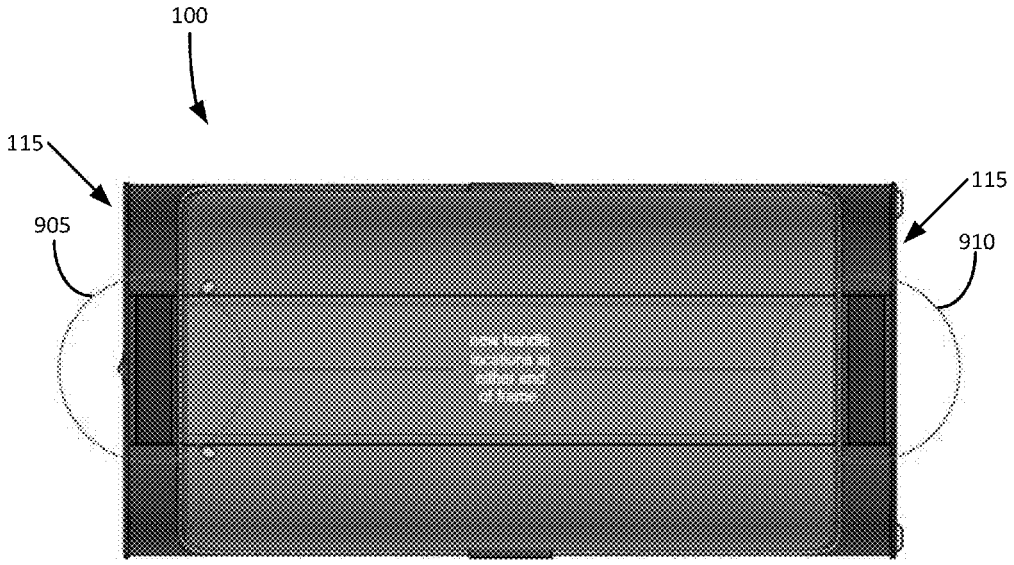
FIGS. 9A and 9B illustrate the luggage bag of FIG. 1 in the closed configuration, including multiple grab handles disposed thereon.
Figure 9B:
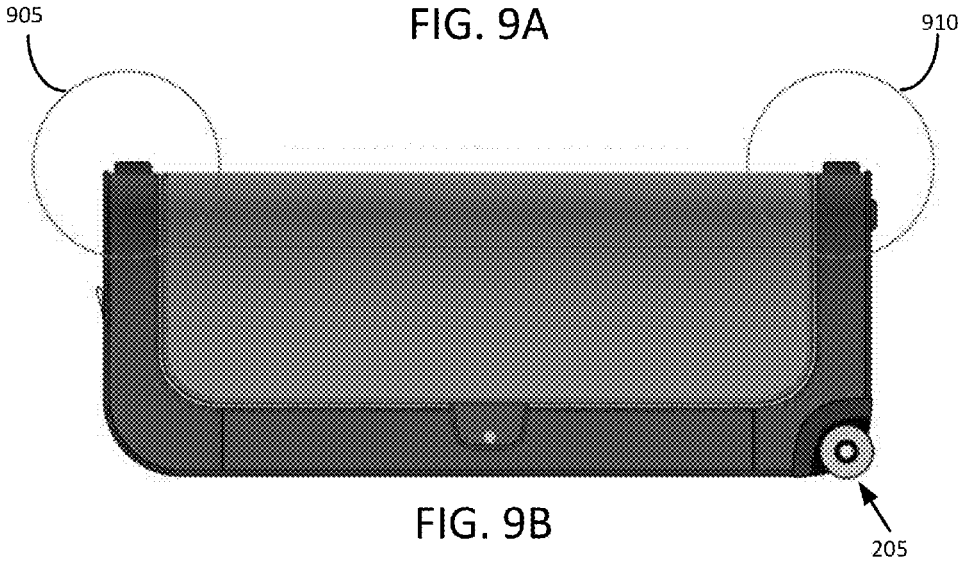

FIGS. 9A and 9B illustrate the luggage bag 100 of FIG. 1 in the closed configuration, including multiple grab handles 905 and 910 disposed thereon. As shown in FIGS. 9A and 9B, the luggage bag 100 can include a first grab handle 905 disposed atop one of the walls 115 opposite the telescoping handle 210 (FIG. 2). In addition, the luggage bag 100 can include a second grab handle 910 disposed atop another of the walls 115 opposite the one or more wheels 205. In this manner, the first and second grab handles 905 and 910 provide two-handed horizontal lifting from a trunk or baggage carousel, for example.

Figure 10:
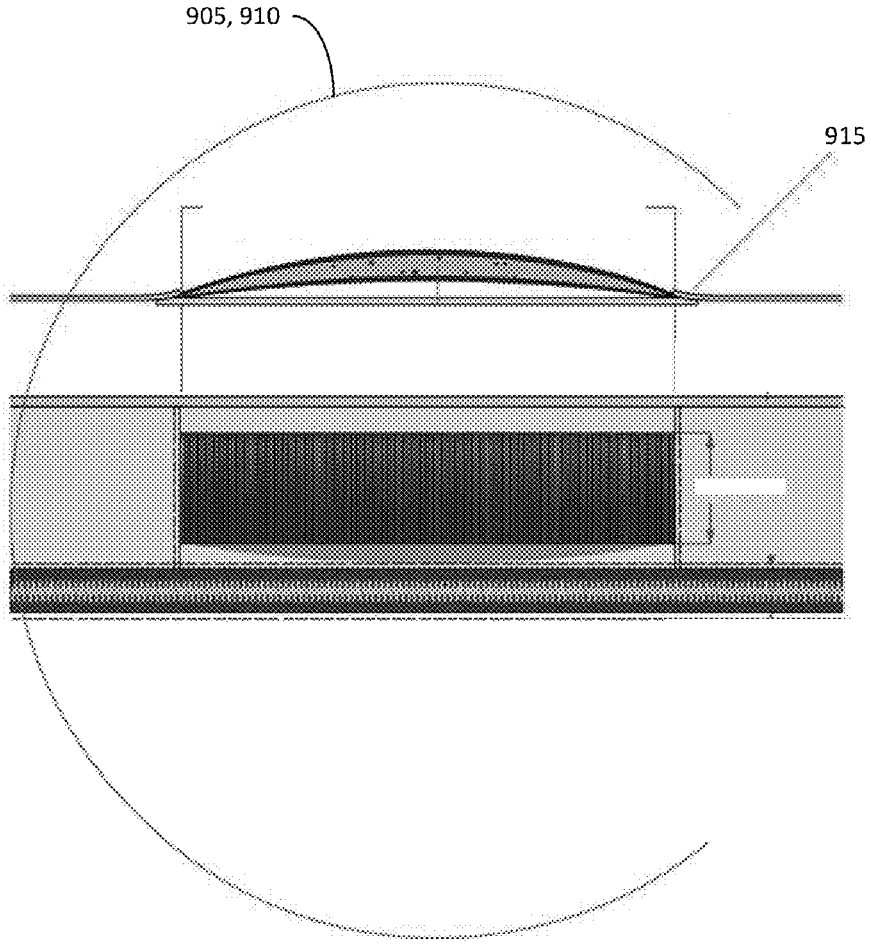
FIG. 10 illustrates a close-up view of a grab handle of FIGS. 9A and 9B.

FIG. 10 illustrates a close-up cross sectional view of the grab handles of FIGS. 9A and 9B. As can be seen, the grab handles can be captured and secured at seams 915. In addition, the grab handles 905 and 910 can be made of tubular webbing that is stuffed with cross-link foam or other suitable stuffing material. In this manner, the grab handles 905 and 910 provide comfortable and efficient lifting access to the luggage bag 100.

Figure 11:
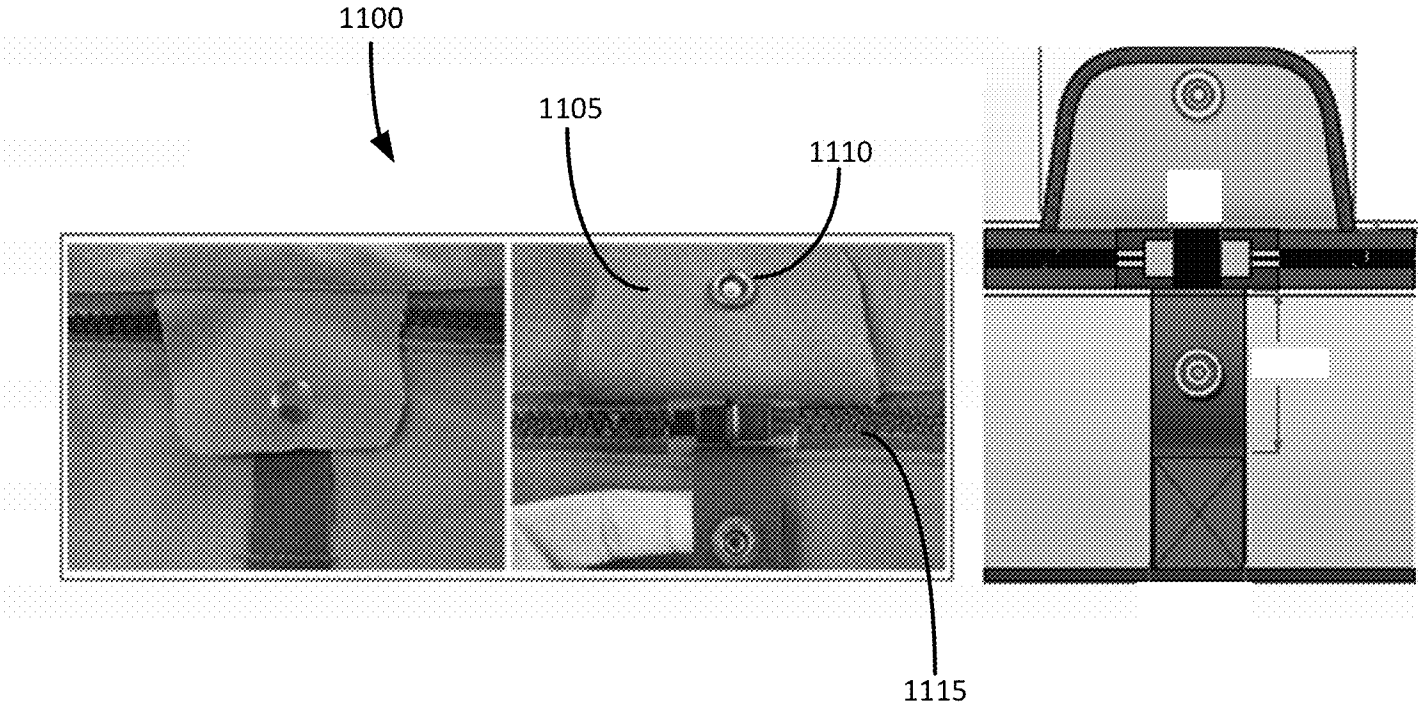
FIG. 11 illustrates a close-up of an example of a detachable zipper and flap construction.

FIG. 11 illustrates a close-up of an example of a detachable zipper and flap mechanism 1100. The detachable zipper and flap mechanism 1100 can include a connective cover flap 1105, which may include a securing means such as a snap 1110. The connective cover flap 1105 may fold down over an adjoining zipper section 1115 and snap into place using the securing means 1110. The connective cover flap 1105 may therefore cover and secure one or more locations on the luggage bag 100 where zippers or other connectors meet.

Thus, the luggage bag 100 can be very portable and can securely store items within the organizer 110 in an orderly manner. The organizer 110 can also be configured in a wide variety of ways according to the desires of the user.

Having described and illustrated the principles of the invention with reference to illustrated embodiments, it will be recognized that the illustrated embodiments can be modified in arrangement and detail without departing from such principles, and can be combined in any desired manner. And although the foregoing discussion has focused on particular embodiments, other configurations are contemplated. In particular, even though expressions such as "according to an embodiment of the invention" or the like are used herein, these phrases are meant to generally reference embodiment possibilities, and are not intended to limit the invention to particular embodiment configurations. As used herein, these terms can reference the same or different embodiments that are combinable into other embodiments.

Consequently, in view of the wide variety of permutations to the embodiments described herein, this detailed description and accompanying material is intended to be illustrative only, and should not be taken as limiting the scope of the invention. What is claimed as the invention, therefore, is all such modifications as may come within the scope and spirit of the following claims and equivalents thereto.

The invention claimed is:

1. A luggage bag, comprising:

an outer container including a flap including connection means for connecting to the outer container; and a removable organizer configured to be stored within the outer container and covered by the flap, wherein the removable organizer comprises:

first, second, and third compartments;

a first connector located along one region of a bottom wall of the first compartment;

a second connector located along another region of a top wall of the third compartment;

a first pull handle or strap connected to the first compartment; and a second pull handle or strap connected to the first compartment, wherein the first connector connects the first compartment to the second compartment such that the first connector connects adjacent bottom walls of the first and second compartments, wherein the second connector connects the third compartment to the second compartment such that the second connector connects adjacent top walls of the third and second compartments, wherein the first pull handle or strap is configured to unfold and deploy the first, second, and third compartments from the outer container, wherein the second pull handle or strap is configured to fold the first, second, and third compartments one atop the other into the outer container, and wherein the first, second, and third compartments are entirely removable from the outer container and configured to unfold one from another.

2. The luggage bag of claim 1, wherein the flap includes an envelope that is configured to store one or more garments, wherein the envelope includes a plurality of pleated gussets, wherein the envelope includes a plurality of shoulder seams that are angled relative to a top edge of the envelope, wherein a volume of the envelope is defined at least in part by the plurality of shoulder seams, wherein the envelope includes a webbing section to provide ventilation, and wherein the envelope includes a strap and buckle mechanism spanning an entire width of the envelope for gathering and securing a lower portion of the one or more garments stored within the envelope.

3. The luggage bag of claim 1, wherein:

the first compartment includes first, second, third, and fourth sidewalls, the bottom wall and the first, second, third, and fourth sidewalls of the first compartment are substantially opaque, the top wall of the first compartment is at least partially light-transmissive, the second compartment includes first, second, third, and fourth sidewalls, that are separate and spaced apart from the first and third compartments, the bottom wall and the first, second, third, and fourth sidewalls of the second compartment are substantially opaque, the top wall of the second compartment is at least partially light-transmissive, the third compartment includes first, second, third, and fourth sidewalls that are separate and spaced apart from the first and second compartments, the bottom wall and the first, second, third, and fourth sidewalls of the third compartment are substantially opaque, the top wall of the third compartment is at least partially light-transmissive, the light-transmissive wall of the first compartment is at least partially removably attached to one or more other walls of the first compartment, the light-transmissive wall of the second compartment is at least partially removably attached to one or more other walls of the second compartment, and the light-transmissive wall of the third compartment is at least partially removably attached to one or more other walls of the third compartment.

4. The luggage bag of claim 3, wherein:

the first, second, and third compartments are made of compression molded material, the first compartment of the removable organizer includes a first interior dividing wall and a second interior dividing wall that are molded into the bottom wall of the first compartment, the first interior dividing wall is arranged perpendicular to the second interior dividing wall, the first and second interior dividing walls have a height that is less than the height of the first, second, third, and fourth sidewalls of the first compartment, the second compartment of the removable organizer includes a third interior dividing wall and a fourth interior dividing wall that are molded into the bottom wall of the second compartment, the third interior dividing wall is arranged perpendicular to the fourth interior dividing wall, the third and fourth interior dividing walls have a height that is less than the height of the first, second, third, and fourth sidewalls of the second compartment, the third compartment of the removable organizer includes a fifth interior dividing wall and a sixth interior dividing wall that are molded into the bottom wall of the third compartment, the fifth interior dividing wall is arranged perpendicular to the sixth interior dividing wall, and the fifth and sixth interior dividing walls have a height that is less than the height of the first, second, third, and fourth sidewalls of the third compartment.

5. The luggage bag of claim 4, wherein:

the first and second interior dividing walls have a height that is less than one half the height of the first, second, third, and fourth sidewalls of the first compartment, the third and fourth interior dividing walls have a height that is less than one half the height of the first, second, third, and fourth sidewalls of the second compartment, and the fifth and sixth interior dividing walls have a height that is less than one half the height of the first, second, third, and fourth sidewalls of the third compartment.

6. The luggage bag of claim 1, wherein:

the first pull handle or strap is connected at an end of the removable organizer in a first region including a top wall and a first sidewall of the first compartment, and the second pull handle or strap is connected in a second region including the top wall and a second sidewall opposite the first sidewall of the first compartment.

7. The luggage bag of claim 6, wherein:

the second pull handle or strap is disposed between the first compartment and the second compartment, and the second pull handle is disposed directly opposite the first connector relative to the second sidewall of the first compartment.

8. The luggage bag of claim 7, wherein:

the second pull handle or strap is configured to be lifted such that the first compartment is configured to be folded on the second compartment, and the second compartment is configured to be folded on the third compartment, in a folded configuration, and in the folded configuration, the first and third compartments are in an upright orientation, and the second compartment is in an inverted orientation.

9. The luggage bag of claim 1, wherein the outer container further comprises:

a first rigid wall disposed at a first end of the outer container, wherein the first rigid wall includes a first curved corner and a second curved corner that maintain their shape whether in an open configuration or a closed configuration; and a second rigid wall disposed at a second end opposite the first end of the outer container, wherein the second rigid wall includes a third curved corner and a fourth curved corner that maintain their shape whether in the open configuration or the closed configuration, wherein the garment flap is configured to be attached, by the connection means, to the first rigid wall along the first curved corner and the second curved corner, and to the second rigid wall along the third curved corner and the fourth curved corner, such that the garment flap is configured to cover the removable organizer within the outer container.

10. The luggage bag of claim 9, wherein:

the removable organizer is configured to fit in a folded configuration between the first rigid wall and the second rigid wall within the outer container.

11. The luggage bag of claim 9, further comprising:

a first grab handle disposed atop the first rigid wall; and a second grab handle disposed atop the second rigid wall.

12. The luggage bag of claim 11, wherein:

each of the first and second grab handles include tubular webbing stuffed with cross-link foam.

13. The luggage bag of claim 9, further comprising:

an external-access storage area disposed on an outer surface of the first rigid wall.

14. The luggage bag of claim 9, further comprising:

one or more cargo pockets disposed on an inner surface of the second rigid wall.

15. The luggage bag of claim 1, wherein:

the connection means includes at least one of a zipper, a button, or a snap.

16. The luggage bag of claim 1, wherein:

the outer container including the garment flap encapsulate the removable organizer.

17. The luggage bag of claim 1, wherein:

the removable organizer is configured to unfold, deploy, and extend from the outer container.

18. The luggage bag of claim 1, wherein:

the first connector includes a first zipper, and the second connector includes a second zipper.

* * * * *